US005721190A

United States Patent [19]

Miyamoto et al.

[11] Patent Number: 5,721,190

[45] Date of Patent: Feb. 24, 1998

[54] THERMOSENSITIVE RECORDING MEDIUM

[75] Inventors: Shuji Miyamoto; Yasutomo Mori; Takeshi Akimoto, all of Numazu, Japan

[73] Assignee: Ricoh Company, Ltd., Tokyo, Japan

[21] Appl. No.: 674,678

[22] Filed: Jul. 2, 1996

[30] Foreign Application Priority Data

Jul. 4, 1995 [JP] Japan ..... 7-189714
Jul. 1, 1996 [JP] Japan ..... 8-188061

[51] Int. Cl.[6] ..... B41M 5/30

[52] U.S. Cl. ..... 503/207; 503/200; 503/209; 503/226

[58] Field of Search ..... 427/150–152; 503/208, 209, 212, 216, 225, 200, 207, 226

[56] References Cited

U.S. PATENT DOCUMENTS

| | | | |
|---|---|---|---|
| 3,157,526 | 11/1964 | Johnson et al. | 503/212 |
| 4,287,264 | 9/1981 | Marginean | 428/514 |
| 4,289,535 | 9/1981 | Marginean et al. | 106/219 |
| 4,459,336 | 7/1984 | Miyakawa | 503/208 |
| 4,987,118 | 1/1991 | Murata et al. | 503/200 |

OTHER PUBLICATIONS

Patent Abstracts of Japan, vol. 12, No. 183 (M–703), May 28, 1988, JP–62–294587, Dec. 22, 1987.
Patent Abstracts of Japan, vol. 10, No. 277, (M–519), Sep. 19, 1986, JP–61–098586, May 16, 1986.
Patent Abstracts of Japan, vol. 9, No. 261, (M–422), Oct. 18, 1985, JP–60–107387, Jun. 12, 1985.
Patent Abstracts of Japan, vol. 8, No. 143,(M–306), Jul. 4, 1984, JP–59–041296, Mar. 7, 1984.
Patent Abstracts of Japan, vol. 6, No. 45, (M–118), Mar. 20, 1982, JP–56–159199, Dec. 8, 1981.
Patent Abstracts of Japan, vol. 17, No. 229, (M–1406), May 11, 1993, JP–04–358883, Dec. 11, 1992.
Database WPI, Derwent Publications, AN–84–228076, JP–59–135187, Aug. 3, 1984.
Patent Abstracts of Japan, vol. 18, No. 41, (M–1546), Jan. 21, 1994, JP–05–270136, Oct. 19, 1993.
Patent Abstracts of Japan, vol. 96, No. 2, Feb. 29, 1996, JP–07–266696, Oct. 17, 1995.

*Primary Examiner*—Bruce H. Hess
*Attorney, Agent, or Firm*—Oblon, Spivak, McClelland, Maier & Neustadt, P.C.

[57] ABSTRACT

A thermosensitive recording medium including a support, and at least one layer provided on the support, wherein one of the at least one layer is a thermosensitive layer capable of forming a color image when heated imagewise, and one of the at least one layer contains a zinc dithiocarbamate of the formula:

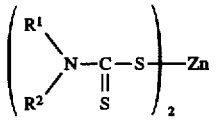

wherein $R^1$ and $R^2$ stand independently from each other for an alkyl group having 1–4 carbon atoms or a phenyl group. The zinc dithiocarbamate is contained in the thermosensitive layer or an intermediate layer interposed between the thermosensitive layer and the support.

5 Claims, No Drawings

THERMOSENSITIVE RECORDING MEDIUM

BACKGROUND OF THE INVENTION

This invention relates to a thermosensitive recording medium having a support and a thermosensitive color-developing layer formed on the support and containing a leuco dye and a color developer capable of reacting with the leuco dye at an elevated temperature to develop a color.

Thermosensitive recording media capable of thermally recording an image through coloring reaction of a colorless or light-color leuco dye with a developer such as a phenol compound are now increasingly utilized in various fields such as recording papers for printers of computers, medical measuring instruments and facsimile machines, automatic ticket vending machines, thermosensitive copying machines and POS (point of sales) labels.

One problem of the known thermosensitive recording media is that the images and background are apt to be discolored when exposed to light such as sunlight or room lamps. In particular, the image density is gradually lowered or the background is colored when irradiated with light. To cope with this problem, there is a proposal to incorporate a benzotriazole compound as a UV absorbing agent into the thermosensitive layer (JP-A-63-307981, etc.). The use of such a benzotriazole compound is, however, still unsatisfactory because the lightfastness is gradually lost with time.

SUMMARY OF THE INVENTION

It is, therefore, an object of the present invention to provide a thermosensitive recording medium having excellent lightfastness.

Another object of the present invention is to provide a thermosensitive recording medium free of discoloration and deterioration of recorded images and free of coloration of the background even when exposed to light irradiation for a long time.

In accomplishing the foregoing object, there is provided in accordance with the present invention a thermosensitive recording medium comprising a support, and a thermosensitive layer provided on said support and capable of forming a color image when heated imagewise, said thermosensitive layer containing a zinc dithiocarbamate of the formula:

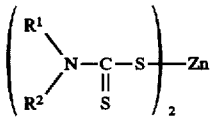

wherein $R^1$ and $R^2$ are independently selected from the group consisting of alkyl groups having 1–4 carbon atoms and a phenyl group.

The present invention also provides a thermosensitive recording medium comprising a support, a thermosensitive layer provided on said support and capable of forming a color image when heated imagewise, and an intermediate layer interposed between said support and said thermosensitive layer and containing a zinc dithiocarbamate of the formula:

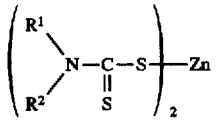

wherein $R^1$ and $R^2$ are independently selected from the group consisting of alkyl groups having 1–4 carbon atoms and a phenyl group.

Other objects, features and advantages of the present invention will become apparent from the detailed description of the preferred embodiments of the invention to follow.

DETAILED DESCRIPTION OF THE PREFERRED EMBODIMENTS OF THE INVENTION

The thermosensitive recording medium of the present invention has a support on which a thermosensitive color-developing layer containing a leuco dye and a color developer is supported. Any conventionally used support, such as paper, a plastic film or a synthetic paper, may be suitably used for the purpose of the present invention. If desired, an intermediate layer may be interposed between the support and the thermosensitive color-developing layer.

It is important that either the thermosensitive color-developing layer or the intermediate layer should contain a zinc dithiocarbamate of the formula:

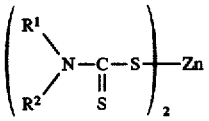

wherein $R^1$ and $R^2$ are independently selected from alkyl groups having 1–4 carbon atoms and a phenyl group. The phenyl group may have one or more substituents such as an alkyl group or a halogen atom. From the standpoint of sensitivity and lightfastness, the use of a zinc dithiocarbamate having a melting point of 190°–250° C. is preferred.

The zinc dithiocarbamate is suitably used in an amount of 0.1–3 parts by weight per part by weight of the leuco dye.

Any leuco dye customarily employed in the field of thermosensitive recording material may be suitably used for the purpose of the present invention. For example, triphenylmethane leuco compounds, triarylmethane leuco compounds, fluoran leuco compounds, phenothiazine leuco compounds, thiofluorane leuco compounds, xanthene leuco compounds, indolylphthalide leuco compounds, spiropyran leuco compounds, azaphthalide leuco compounds, chromenopyrazol leuco compounds, methyne leuco compounds, rhodamine anilinolactam leuco compounds, rhodamine lactam leuco compounds, quinazoline leuco compounds, diazaxanthene leuco compounds and bislactone leuco compounds.

Illustrative of suitable leuco compounds are 3,3-bis(p-dimethylaminophenyl)phthalide, 3,3-bis(p-dimethylaminophenyl)-6-dimethylaminophthalide (or Crystal Violet Lactone), 3,3-bis(p-dimethylaminophenyl)-6-diethylaminophthalide, 3,3-bis(p-dimethylaminophenyl)-6-chlorophthalide, 3,3-bis(p-dibutylaminophenyl)phthalide, 3-cyclohexylamino-6-chlorofluoran, dimethylamino-5,7-dimethylfluoran, 3-diethylamino-7-chlorofluoran, 3-diethylamino-7-methylfluoran, 3-diethylamino-7,8-benzfluoran, 3-diethylamino-6-methyl-7-chlorofluoran, 3-dibutylamino-6-methyl-7-anilinofluoran, 3-dipentylamino-6-methyl-7-anilinofluoran, 3-(N-p-tolyl-N-ethylamino)-6-methyl-7-anilinofluoran, 3-pyrrolidono-6-methyl-7-anilinofluoran, 2-N-m-trifluoromethylphenylamino-6-diethylaminofluoran, 2-[3,6-bis(diethylamino)-9-(o-chloroanilino)-xanthylbenzoic acid lactam], 3-diethylamino-6-methyl-7-(m-trichloromethylanilino)fluoran, 3-diethylamino-7-(o-chloroanilino)fluoran, 3-dibutylamino-7-(o-chloroanilino)-fluoran, 3-N-methyl-N-amylamino-6-methyl-7-anilinofluoran, 3-N-methyl-N-cyclohexylamino-6-methyl- 7-anilinofluoran, 3-N-methyl-N-isoamylamino-6-methyl-7-anilinofluoran, 3-N-methyl-N-isobutylamino-6-methyl-7-anilinofluoran, 3-diethylamino-6-chloro-7-anilinofluoran, 3-(N-ethyl-N-2-ethoxypropylamino)-6-methyl-7-anilinofluoran, 3-N-ethyl-N-tetrafurfurylamino-6-methyl-7-anilinofluoran, 3-diethylamino-6-methyl-7-anilinofluoran, 3-diethylamino-5-methyl-7-dibenzylaminofluoran, benzoleuco methylene blue, 6-chloro-8-methoxy-2,3-dihydrobenzoindole-2-spiro-2'-(2',3'-dihydro-benzofuran), 6-bromo-8-methoxy-2,3-dihydrobenzoindole-2-spiro-2'-(2',3'-dihydrobenzofuran), 3-(2'-hydroxy-4'-dimethylaminophenyl)-3-(2'-methoxy-5'-chlorophenyl) phthalide, 3-(2'-hydroxy-4'-dimethylaminophenyl)-3-(2'-methoxy-5'-nitrophenyl)phthalide, 3-(2'-hydroxy-4'-diethylaminophenyl)-3(2'-methoxy-5'-methylphenyl) phthalide, 3-diethylamino-6-methyl-7-(2',4-dimethylanilino)fluoran, 3-(2'-methoxy-4'-dimethylaminophenyl)-3-(2'-hydroxy-4'-chloro-5'-methylphenyl) phthalide,3-morpholino-7-(N-propyl-N-o-trifluoromethylphenylamino)fluoran, 3-morpholino-7-(N-propyl-N-m-trifluoromethylphenylamino) fluoran, 3-morpholino-7-(N-propyl-N-p-trifluoromethylphenylamino) fluoran, 3-pyrrolidino-7-o-trifluoromethylanilinofluoran, 3-pyrrolidino-7-m-trifluoromethylanilinofluoran, 3-pyrrolidino-7-p-trifluoromethylanilinofluoran, 3-diethylamino-5-chloro-7-(N-benzyl-N-trifluoromethylphenylamino)fluoran, 3-pyrrolidino-7-(di-p-chlorophenyl)methylaminofluoran, 3-diethylamino-5-chloro-7-(α-phenylethylamino)fluoran, 3-N-ethyl-N-p-methylphenylamino-7-(α-phenylethylamino)fluoran, 3-diethylamino-7-(o-methoxycarbonylphenylamino) fluoran, 3-diethylamino-5-methyl-7-(α-phenylethylamino)fluoran, 3-diethylamino-7-piperidinofluoran, 2-chloro-3-N-methyl-N-o-methylphenylamino-7-(p-n-butylanilino)fluoran, 2-chloro-3-N-methyl-N-m-methylphenylamino-7-(p-n-butylanilino) fluoran, 2-chloro-3-N-methyl-N-p-methylphenylamino-7-(p-n-butylanilino)-fluoran, 3-N-benzyl-N-cyclohexylamino-5,6-benzo-7-α-naphthylamino-4'-bromofluoran, 3-diethylamino-6-methyl-7-mesidino-4',5'-benzofluoran, 3-(p-dimethylaminophenyl)-3-[2,2-bis(p-dimethylaminophenyl)ethenyl]phthalide, 3-(p-dimethylaminophenyl)-3-[2,-bis(p-dimethylaminophenyl)-ethenyl]-6-dimethylaminophthalide, 3-(p-dimethylaminophenyl)3-(2-p-dimethylaminophenyl-2-phenyletheyl)phthalide, 3-(p-dimethylaminophenyl)-3-(2-p-dimethylaminophenyl-2-p-chlorophenylethenyl)-6-dimethylaminophthalide, 3-(4'-dimethylamino-2'-methoxyphenyl)-3-(4"-p-dimethylaminophenyl-4"-p-chlorophenyl-1",3"-butadienyl)-5,6-benzophthalide, 3-(4'-dimethylamino-2'-benzyloxyphenyl)-3-(4"-p-dimethylaminophenyl-4"-phenyl-1",3"-butadienyl)-5,6-benzophthalide, 3-dimethylamino-6-dimethylaminofluorene-9-spiro-3'-(6'-dimethylamino) phthalide, 3,3-bis[2-(p-dimethylaminophenyl)-2-(p-methoxyphenyl)ethenyl]-4,5,6,7-tetrachlorophthalide, 3-bis[2,2-bis(4-pyrrolidinophenyl)-ethenyl]-5,6-dichloro-4,7-dibromophthalide, bis(p-dimethyl-aminostyryl)-1-naphthalenesulfonylmethane and bis(p-dimethyl-aminostyryl)-1-p-tolylsulfonylmethane. These leuco dyes may be used singly or in combination of two or more thereof.

The leuco dye is generally used in an amount of 10–50% by weight, preferably 20–40% by weight based on the weight of the thermosensitive color-developing layer for reasons of color density and storage stability.

Any developer customarily used in the field of thermosensitive recording material may be suitably used for the purpose of the present invention. Illustrative of suitable developers are 4,4'-isopropylidenediphenol, 4,4'-isopropylidenebis(o-methylphenol), 4,4'-5-butylidenediphenol, 4,4'-isopropylidenebis(2-t-butylphenol), zinc p-nitrobenzoate, 1,3,5-tris(4-t-butyl-3-hydroxy-2,6-dimethylbenzyl) isocyanuric acid, 2,2-(3',4'-dihydroxyphenyl)propane, bis(4 -hydroxy-3-methylphenyl) sulphide, 4-[β-(p-methoxyphenoxy)ethoxy]salicylic acid, 1,7-bis(4-hydroxyphenylthio)-3,5-dioxaheptane, 1,5-bis(4-hydroxyphenylthio)-5-oxapentane, monocalcium monobenzylphthalate, 4,4'-cyclohexylidenediphenol, 4,4'-isopropylidenebis(2-chlorophenol), 2,2-methylenebis(4-methyl-6-tert-butylphenol), 2,2'-methylenebis(4-ethyl-6-tert-butylphenol), 4,4'butylidenebis(6-tert-butyl-2-methylphenol), 1,1,3-tris(2-methyl-4-hydroxy-5-tert-butylphenyl)butane, 1,1,3-tris(2-methyl-4-hydroxy-5-cyclohexylphenyl)butane, 4,4'-thiobis(6-tert-butyl-2-methylphenol), 4,4'-diphenolsulfone, 4-isopropoxy-4'-hydroxydiphenylsulfone, 4-benzyloxy-4'-hydroxydiphenylsulfone, 4,4'-diphenolsulfoxide, isopropyl p-hydroxybenzoate, benzyl p-hydroxybenzoate, benzyl protocatechuate, stearyl gallate, lauryl gallate, octyl gallate, 1,3-bis(4-hydroxyphenylthio)propane, N,N'-diphenylthiourea, N,N'-di(m-chlorophenyl)thiourea, salicylanilide, methyl bis(4-hydroxyphenyl)acetate, benzyl bis(4-hydroxyphenyl)acetate, 2,4'-diphenolsulfone, 2,2'-diallyl-4,4'-diphenolsulfone, 3,4-dihydroxyphenyl-4'-methyldiphenylsulfone, zinc 1-acetyloxy-2-nathoate, zinc 2-acetyloxy-1-naphthoate, zinc 2-acetyloxy-3-naphthoate, α,α-bis(4-hydroxyphenyl)-α-methyltoluene, antipyrine complex of zinc thiocyanate, tetrabromobisphenol A, tetrabromobisphenol s, 4,4'-thiobis(2-methylphenol) and 4,4'-thiobis(2-chlorophenol). The above color developers may be used singly or in combination of two or more thereof.

The color developer is generally used in an amount of 1–5 times, preferably 2–4 times, the weight of the leuco dye for reasons of color density and storage stability.

The thermosensitive layer may contain a binder to firmly bond the layer to the support. Any binder conventionally used in the field of the thermosensitive recording medium may be employed for the purpose of the present invention. Illustrative of suitable binders are water-soluble polymers such as polyvinyl alcohol, carboxyl group-modified polyvinyl alcohol, starch, starch derivatives, hydroxyethylcellulose, hydroxymethylcellulose, ethylcellulose, methylcellulose, carboxymethylcellulose, sodium polyacrylate, polyvinyl pyrrolidone, an acrylamide-acrylate copolymer, an acrylamide-acrylate-methacrylic acid terpolymer, a salt of a styrene-maleic anhydride copolymer, a salt of a styrene-acrylic acid copolymer, a salt of isobutylene-maleic anhydride copolymer, polyacrylamide, sodium alginate, gelatin and casein; and aqueous emulsions such as a styrene-butadiene copolymer, a styrene-butadiene-acrylic acid (or acrylate) copolymer latex, polyvinyl acetate, a vinyl acetate-acrylic acid copolymer, a styrene-acrylate copolymer, polyurethane, polyacrylate, polymethacrylate, a vinylchloride-vinyl acetate copolymer and an ethylene-vinyl acetate copolymer.

Various additives may be further incorporated into the thermosensitive layer. The additives include an inorganic or organic filler such as silica, zinc oxide, aluminum hydroxide, zinc hydroxide, barium sulfate, kaolin, clay, talc, calcium carbonate, magnesium carbonate, calcined clay, titanium oxide, diatomaceous earth, anhydrous silica, activated clay, surface treated calcium, styrene-methacrylic acid copolymer powder, nylon powder, polyethylene powder, polystyrene powder or urea-formaldehyde resin powder; a fusible substance (or lubricant) having a melting point of 50°–200° C., such as a fatty acid, a fatty acid ester, a fatty amide, a fatty acid salt (e.g. zinc stearate or calcium stearate), a wax (e.g. a stearate wax, polyethylene wax, carnauba wax, microcrystalline wax or carboxyl-modified paraffin wax), an aromatic carboxylic acid-amine condensation product, phenyl benzoate, higher straight-chain glycol, dialkyl 3,4-epoxyhexahydrophthalate, higher ketone, p-benzylbiphenyl, dibenzyl oxalate, di-p-methylbenzyl oxalate or a metaterphenyl; and a surfactant.

If desired, various other additional layers may be provided in the thermosensitive recording medium. For example, a protecting layer may be provided over the surface of the thermosensitive color-developing layer for protecting same and, in particular, for improving matching property of the thermosensitive recording medium with a thermal head. The overcoat layer is preferably formed of a water-soluble organic polymeric material such as polyvinyl alcohol, carboxyl group-modified polyvinyl alcohol, amino group-modified polyvinyl alcohol, starch, starch derivatives, methoxycellulose, hydroxyethylcellulose, carboxymethylcellulose, hydroxymethylcellulose, ethylcellulose, methylcellulose, polyacrylic acid, polyacrylic derivatives, a styrene-acrylic acid copolymer, styrene-acrylic acid copolymer derivatives, a styrene-acrylic acid-acrylamide terpolymer, polyethylene imine, a water-soluble polyester, water soluble polyurethane, an isobutylene-maleic anhydride copolymer or isobutylene-maleic anhydride copolymer derivatives. If desired, water insoluble polyester, polyurethane, an acrylate copolymer, styrene-acrylate copolymer, an epoxy resin, polyvinyl acetate, polyvinylidene chloride or polyvinyl chloride may also be used for the formation of the protecting layer.

The protecting layer may further contain a water-proof agent such as formalin, chrome alum, glyoxal, melamine, a melamin-formalin resin, a polyamide resin or a polyamide-epichlorhydrin resin. Various additives such as a filler, a fusible substance, a surfactant and an agent for preventing the color development by pressure may be incorporated into the protecting layer, if desired. The filler and the fusible substance may be as exemplified above with reference to the thermosensitive layer.

Preferably, an intermediate layer is provided between the support and the thermosensitive color-developing layer. The intermediate layer preferably contains a filler in the form of hollow particles (empty beads) having an average particle size of 2–10 μm, an outside diameter $D_o$ and an inside diameter $D_i$ which is at least 90% of the outside diameter $D_o$. The hollow filler is generally used in an amount of at least 30%, preferably 50–80%, of the volume of the intermediate layer. Illustrative of suitable hollow fillers are those formed of a polymer having a high elasticity such as a vinylidene chloride-acrylonitrile copolymer. A binder such as described above may be used for supporting the beads in the intermediate layer and for bonding the layer to the adjacent layer and the support.

The thermosensitive color-developing layer may be formed on the support by applying a coating of a composition containing the above ingredients. For example, the above ingredients are homogeneously dispersed in a suitable dispersing medium such as water and the resulting dispersion is coated by a wire bar or any other suitably coating means to a predetermined thickness over the support, followed by drying of the coat. The color-developing layer generally has a thickness of 2–10 μm, preferably 4–8 μm.

The thermosensitive recording medium thus constructed may be heated imagewise with a thermal head to give a color-developed image.

The following examples will further illustrate the present invention. Parts and percentages are by weight.

EXAMPLE 1

Preparation of Dispersion A:

The following components were ground with a sand mill into an average particle diameter of 2 μm to obtain Dispersion A.

| | |
|---|---|
| 3-dipentylamino-6-methyl-7-anilinofluoran | 20 parts |
| 10% aqueous polyvinyl alcohol solution | 20 parts |
| Water | 60 parts |

Preparation of Dispersion B:

The following components were ground with a sand mill into an average particle diameter of 2 μm to obtain Dispersion B.

| | |
|---|---|
| di-p-methylbenzyl oxalate | 10 parts |
| 10% aqueous polyvinyl alcohol solution | 12.5 parts |
| calcium carbonate | 15 parts |
| water | 97.5 parts |

Preparation of Dispersion C:

The following components were ground with a sand mill into an average particle diameter of 2 μm to obtain Dispersion C.

| | |
|---|---|
| zinc dibutyldithiocarbamate | 20 parts |
| 10% aqueous polyvinyl alcohol solution | 20 parts |
| Water | 60 parts |

Preparation of Dispersion D:

The following components were blended to obtain Dispersion D.

| | |
|---|---|
| hollow filler of styrene-acrylate copolymer (solid content: 27.5%, $D_i/D_o$: 0.5) | 45 parts |
| styrene-butadiene copolymer latex (solid content: 47.5%) | 15 parts |
| water | 50 parts |

Preparation of Dispersion F:

The following components were blended to obtain Dispersion F for forming a protecting layer.

| | |
|---|---|
| 10% aqueous polyvinyl alcohol solution | 63 parts |
| epichlorohydrin solution of polyamide (solid content: 25%) | 10 parts |
| silica | 3 parts |
| zinc stearate | 1 part |
| water | 23 parts |

Preparation of Thermosensitive Recording Medium:

Dispersion D obtained above was coated over the surface of high quality paper and dried to form an intermediate layer having a dried weight of 5 g/m$^2$. Dispersions A, B and C were blended with a weight ratio of A:B:C of 2:18:1 and the blend was applied over the intermediate layer and dried to form a thermosensitive color-developing layer having a dried weight of 6.5 g/m$^2$. Dispersion F was then applied over the surface of the thermosensitive color-developing layer and dried to form a protecting layer having a dried weight of 5 g/m$^2$. This was calendared at a pressure of 30 kgf/cm$^2$, thereby obtaining a thermosensitive recording medium according to the present invention.

EXAMPLE 2

Example 1 was repeated in the same manner as described except that zinc diethyldithiocarbamate was substituted for zinc dibutyldithiocarbamate.

EXAMPLE 3

Example 1 was repeated in the same manner as described except that zinc dimethyldithiocarbamate was substituted for zinc dibutyldithiocarbamate.

EXAMPLE 4

Example 1 was repeated in the same manner as described except that zinc ethylphenyldithiocarbamate was substituted for zinc dibutyldithiocarbamate.

EXAMPLE 5

The above Dispersion C was blended with the above Dispersion D with a weight ratio of D:C of 1:0.5. This blend was then coated over the surface of high quality paper and dried to form an intermediate layer having a dried weight of 5.5 g/m$^2$. Dispersions A and B were blended with a weight ratio of A:B of 1:9 and the blend was applied over the intermediate layer and dried to form a thermosensitive color-developing layer having a dried weight of 6 g/m$^2$. Dispersion F was then applied over the surface of the thermosensitive color-developing layer and dried to form a protecting layer having a dried weight of 5 g/m$^2$. This was calendared at a pressure of 30 kgf/cm$^2$, thereby obtaining a thermosensitive recording medium according to the present invention.

EXAMPLE 6

Example 5 was repeated in the same manner as described except that zinc dimethyldithiocarbamate was substituted for zinc dibutyldithiocarbamate.

EXAMPLE 7

Example 5 was repeated in the same manner as described except that zinc ethylphenyldithiocarbamate was substituted for zinc dibutyldithiocarbamate.

EXAMPLE 8

Preparation of Dispersion E:

The following components were blended to obtain Dispersion E.

| | |
|---|---|
| hollow filler of vinylidene chloride-acrylonitrile copolymer (solid content: 40%, $D_f/D_o$: 0.9) | 35 parts |
| styrene-butadiene copolymer latex (solid content: 47.5%) | 15 parts |
| water | 50 parts |

Example 6 was repeated in the same manner as described except that Dispersion E was substituted for Dispersion D.

EXAMPLE 9

Example 7 was repeated in the same manner as described except that Dispersion E was substituted for Dispersion D.

Comparative Example 1

Example 8 was repeated in the same manner as described except that Dispersion C containing zinc dimethyldithiocarbamate was not used.

Comparative Example 2

Preparation of Dispersion G:

The following components were ground with a sand mill into an average particle diameter of 2 μm to obtain Dispersion G.

| | |
|---|---|
| 4,4'-butylidene-bis(3-methyl-6-t-butylphenol) | 20 parts |
| 10% aqueous polyvinyl alcohol solution | 20 parts |
| Water | 60 parts |

Dispersion E obtained above was coated over the surface of high quality paper and dried to form an intermediate layer having a dried weight of 5 g/m$^2$. Dispersions A, B and G were blended with a weight ratio of A:B:G of 1:9:1 and the blend was applied over the intermediate layer and dried to form a thermosensitive color-developing layer having a dried weight of 7 g/m$^2$. Dispersion F was then applied over the surface of the thermosensitive color-developing layer and dried to form a protecting layer having a dried weight of 5 g/m$^2$. This was calendared at a pressure of 30 kgf/cm$^2$, thereby obtaining a thermosensitive recording medium for comparative purposes.

Comparative Example 3

Comparative Example 2 was repeated in the same manner as described except that 2-(2-hydroxy-5-methylphenyl) benzotriazole was substituted for 4,4'-butylidene-bis(3-methyl-6-t-butylphenol), thereby obtaining a thermosensitive recording medium for comparative purposes.

The thermosensitive recording media thus obtained were tested for their thermal sensitivity and lightfastness and backside heat resistance to obtain the results shown in Table 1 below. The test methods are as follows.

Lightfastness:

A sample recording medium is recorded with a heating block at a temperature of 130° C., a contact pressure of 2 kg/cm$^2$ and a contact time of 1 second. The sample is then irradiated with light of 0.35W/m$^2$ (340 μm) from a xenon lamp (weatherometer ATLAS Ci35A manufactured by Toyo Seiki Inc.) for 24 hours. Thereafter, the color densities of the background (BG) and the image (IM) are measured by McBeth Densitometer RD-914 using amber and blue filters, respectively.

Thermal Sensitivity:

Using a simulator having (manufactured by Matsushita Electronic Components Co., Ltd.), a sample recording medium is recorded at an electric power (applied to the thermal head) of 0.45 W/dot, a recording speed of 4 msec/line, a scanning line density of 8×3.85 dot/mm and a pulse width of 0.45 and 0.50 msec. The density of the image thus developed is measured by McBeth Densitometer RD-914.

TABLE 1

| Example | Before Light-fastness Test | | After Light-fastness Test | | Sensitivity | |
|---|---|---|---|---|---|---|
| | | | | | at 0.45 | at 0.50 |
| No. | IM | BG | IM | BG | msec* | msec* |
| 1 | 1.37 | 0.10 | 1.32 | 0.45 | 0.80 | 1.05 |
| 2 | 1.37 | 0.09 | 1.28 | 0.36 | 0.80 | 1.03 |
| 3 | 1.36 | 0.08 | 1.29 | 0.24 | 0.76 | 1.01 |
| 4 | 1.36 | 0.07 | 1.30 | 0.22 | 0.75 | 0.99 |
| 5 | 1.35 | 0.09 | 1.30 | 0.40 | 0.80 | 1.04 |
| 6 | 1.36 | 0.08 | 1.29 | 0.16 | 0.78 | 1.02 |
| 7 | 1.36 | 0.08 | 1.27 | 0.15 | 0.74 | 1.01 |
| 8 | 1.37 | 0.08 | 1.30 | 0.17 | 1.05 | 1.20 |
| 9 | 1.36 | 0.08 | 1.28 | 0.15 | 1.00 | 1.19 |
| Comp.1 | 1.35 | 0.07 | 0.50 | 0.18 | 1.02 | 1.21 |

TABLE 1-continued

| Example | Before Light-fastness Test | | After Light-fastness Test | | Sensitivity | |
|---|---|---|---|---|---|---|
| | | | | | at 0.45 | at 0.50 |
| No. | IM | BG | IM | BG | msec* | msec* |
| Comp.2 | 1.38 | 0.08 | 0.60 | 0.17 | 0.95 | 1.18 |
| Comp.3 | 1.37 | 0.07 | 0.16 | 0.16 | 0.98 | 1.20 |

*pulse width

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A thermosensitive recording medium comprising a support, and a thermosensitive layer provided on said support and capable of forming a color image when heating imagewise, said thermosensitive layer containing a zinc dithiocarbamate of the formula:

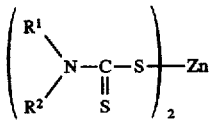

wherein $R^1$ is a phenyl group and $R^2$ is an ethyl group.

2. A thermosensitive recording medium comprising a support, a thermosensitive layer provided on said support and capable of forming a color image when heated imagewise, and an intermediate layer interposed between said support and said thermosensitive layer and containing a zinc dithiocarbamate of the formula:

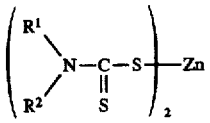

wherein R1 and R2 are independently selected from the group consisting of alkyl groups having 1–4 carbon atoms and a phenyl group.

3. A thermosensitive recording medium as claimed in claim 2, wherein $R^1$ is a phenyl group and $R^2$ is an ethyl group.

4. A thermosensitive recording medium as claimed in claim 2, wherein $R^1$ and $R^2$ are each a methyl group.

5. A thermosensitive recording medium as claimed in claim 2, wherein said intermediate layer additionally contains a filler having an average particle diameter of 2–10 μm and formed of hollow plastic particles each having an inside diameter which is at least 90% of the outer diameter thereof.

* * * * *

UNITED STATES PATENT AND TRADEMARK OFFICE

CERTIFICATE OF CORRECTION

PATENT NO. : 5,721,190
DATED : FEBRUARY 24, 1998
INVENTOR(S) : SHUJI MIYAMOTO, ET AL.

It is certified that error appears in the above-identified patent and that said Letters Patent is hereby corrected as shown below:

Column 6, line 19 insert --4'-hydroxyphenyl-4-isopropoxydiphenylsulfone 10 parts--.

Signed and Sealed this

Twenty-sixth Day of January, 1999

*Attest:*

*Attesting Officer*

*Acting Commissioner of Patents and Trademarks*